US008067904B2

(12) United States Patent
Lin et al.

(10) Patent No.: US 8,067,904 B2
(45) Date of Patent: Nov. 29, 2011

(54) ELECTRONIC BALLAST WITH DIMMING CONTROL FROM POWER LINE SENSING

(75) Inventors: Ko-Ming Lin, Hsin-Chu (TW); Yen-Ping Wang, Hsin-Chu (TW); Pei-Yuan Chen, Hsin-Chu (TW); Wei-Chuan Su, Hsin-Chu (TW); Chia-Chieh Hung, Hsin-Chu (TW); Jian-Shen Li, Hsin-Chu (TW)

(73) Assignee: Grenergy Opto, Inc., Hsin-Chu (TW)

( * ) Notice: Subject to any disclaimer, the term of this patent is extended or adjusted under 35 U.S.C. 154(b) by 324 days.

(21) Appl. No.: 12/505,731

(22) Filed: Jul. 20, 2009

(65) Prior Publication Data

US 2011/0012536 A1 Jan. 20, 2011

(51) Int. Cl.
*H05B 41/36* (2006.01)

(52) U.S. Cl. ..... 315/307; 315/291

(58) Field of Classification Search ..... 315/209 R, 315/186, 291, 297, 302, 307
See application file for complete search history.

(56) References Cited

U.S. PATENT DOCUMENTS

| | | | | |
|---|---|---|---|---|
| 5,798,620 | A * | 8/1998 | Wacyk et al. | 315/307 |
| 7,126,288 | B2 * | 10/2006 | Ribarich et al. | 315/308 |
| 7,414,371 | B1 * | 8/2008 | Choi et al. | 315/291 |
| 2011/0169425 | A1 * | 7/2011 | Sha et al. | 315/307 |

* cited by examiner

*Primary Examiner* — Don Le
(74) *Attorney, Agent, or Firm* — Apex Juris, pllc; Tracy M. Heims

(57) ABSTRACT

The present invention discloses an electronic ballast with dimming control from power line sensing for a fluorescent lamp, comprising: a control voltage generator, used to generate a control voltage according to a switching count of a power line; an oscillator, used to generate an oscillating signal, wherein the oscillating signal is of a fixed frequency and has a rising voltage portion and a falling voltage portion; and a comparator, used to generate a high side gating signal according to voltage comparison of the oscillating signal and the control voltage.

10 Claims, 7 Drawing Sheets

ELECTRONIC BALLAST WITH DIMMING CONTROL FROM POWER LINE SENSING

BACKGROUND OF THE INVENTION

1. Field of the Invention

The present invention relates to electronic ballasts, and more particularly to electronic ballasts with dimming control from power line sensing.

2. Description of the Related Art

In supplying power to gas-discharge lamps such as fluorescent lamps or cold cathode fluorescent lamps or compact fluorescent lamps, electronic ballasts are widely adopted to keep the lamp current stable.

FIG. 1 shows the typical architecture of a prior art electronic ballast with dimming function for driving a fluorescent lamp. As shown in FIG. 1, the prior art electronic ballast with dimming function mainly comprises a full bridge rectifier 101, a $V_{CC}$ start-up circuit 102, a ballast control IC 103, an NMOS transistor 104, an NMOS transistor 105 and a voltage divider 106.

In the architecture, the full bridge rectifier 101 is used to rectify an AC line input voltage to generate a main input voltage $V_{IN}$.

The $V_{CC}$ start-up circuit 102, coupling to the main input voltage $V_{IN}$, is used to start up the generation of a DC voltage $V_{CC}$.

The ballast control IC 103 is used to generate a high side driving signal $V_{HS}$ for driving the NMOS transistor 104 and a low side driving signal $V_{LS}$ for driving the NMOS transistor 105 to deliver a current $I_{LMP}$ to the fluorescent lamp, in response to the voltage at the DIM input pin 3.

The NMOS transistor 104 and the NMOS transistor 105 are used for generating a square waveform to a LC resonant network. The LC resonant network then converts the square waveform to a current signal $I_{LMP}$ to drive the lamp.

The voltage divider 106 is coupled to a 110V DIM input to generate a DIM control voltage at the DIM input pin 3 of the ballast control IC 103. The 110V DIM input is an additional port to the electronic ballast. In the prior art, the 110V DIM input is generally coupled to an additional dial switch (wall dimmer) or a remote control means, and users have to operate the additional dial switch or the remote control means other than an existing lamp rocker switch to trigger the electronic ballast to adjust the luminance of the lamp.

Through the setting of the DIM input, the NMOS transistor 104 and the NMOS transistor 105 are periodically switched on-and-off by the high side driving signal $V_{HS}$ and the low side driving signal $V_{LS}$ respectively, and the input power is transformed from the main input voltage $V_{IN}$ to the lamp in the form of a current signal $I_{LMP}$ of which the root-mean-square value is corresponding to the setting of the DIM input.

However, since the setting of the DIM input in the prior art has to be done by manipulating an additional dial switch or a remote control means other than an existing lamp switch, users have to pay more cost for the additional dial switch or remote control means. Besides, the additional dial switch may have to be mounted on the wall wherein the wiring between the dial switch and the ballast is bothersome. As to the remote control means, the communication between the transmitter and the receiver needs power, and if the remote control means runs out of battery, then there is no way to dim the lamp unless the battery is replaced.

Therefore, there is a need to provide a solution capable of reducing the cost and eliminating the need of an additional dial switch or remote control means in implementing an electronic ballast with dimming function.

Seeing this bottleneck, the present invention proposes a novel topology of electronic ballast capable of dimming the fluorescent lamp by adjusting the duty ratio of a fixed-frequency square signal according to the count of switching of a corresponding lamp switch, without the need of any additional dial switch or remote control means.

SUMMARY OF THE INVENTION

One objective of the present invention is to provide an electronic ballast with dimming control from power line sensing which does not need any additional dial switch or remote control means in the luminance adjustment of the lamp.

Another objective of the present invention is to provide an electronic ballast with dimming function which is accomplished by adjusting the duty ratio of a fixed-frequency square signal according to the count of switching of a corresponding lamp switch.

Still another objective of the present invention is to provide a fully integrated single chip electronic ballast with concise architecture which can control the luminance of the lamp by adjusting the duty ratio of a fixed-frequency square signal according to a switching count of a corresponding lamp switch.

To achieve the foregoing objectives, the present invention provides an electronic ballast with dimming control from power line sensing for a fluorescent lamp, comprising: a control voltage generator, used to generate a control voltage according to a switching count of a power line; an oscillator, used to generate a first oscillating signal and a second oscillating signal, wherein the first oscillating signal is of a fixed frequency and has a rising voltage portion and a falling voltage portion, and the second oscillating signal is a square signal of which the frequency is half of that of the first oscillating signal; a comparator, used to generate a first high side gating signal according to voltage comparison of the first oscillating signal and the control voltage; and an AND gate, used to generate a high side gating signal according to the first high side gating signal and the second oscillating signal.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
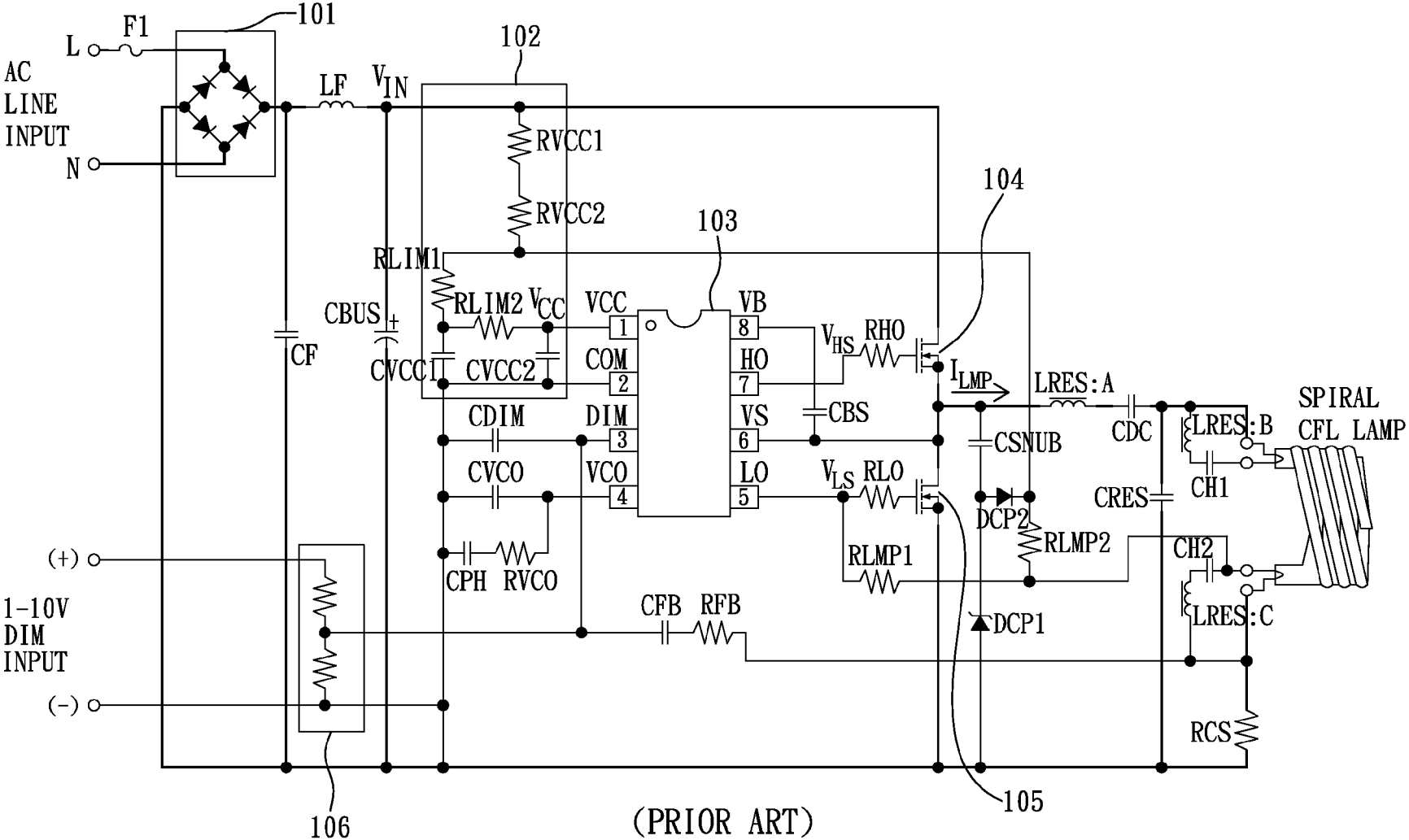
(PRIOR ART) FIG. 1
FIG. 1 is the typical architecture of a prior art electronic ballast with dimming function for driving a fluorescent lamp.
Figure 2:
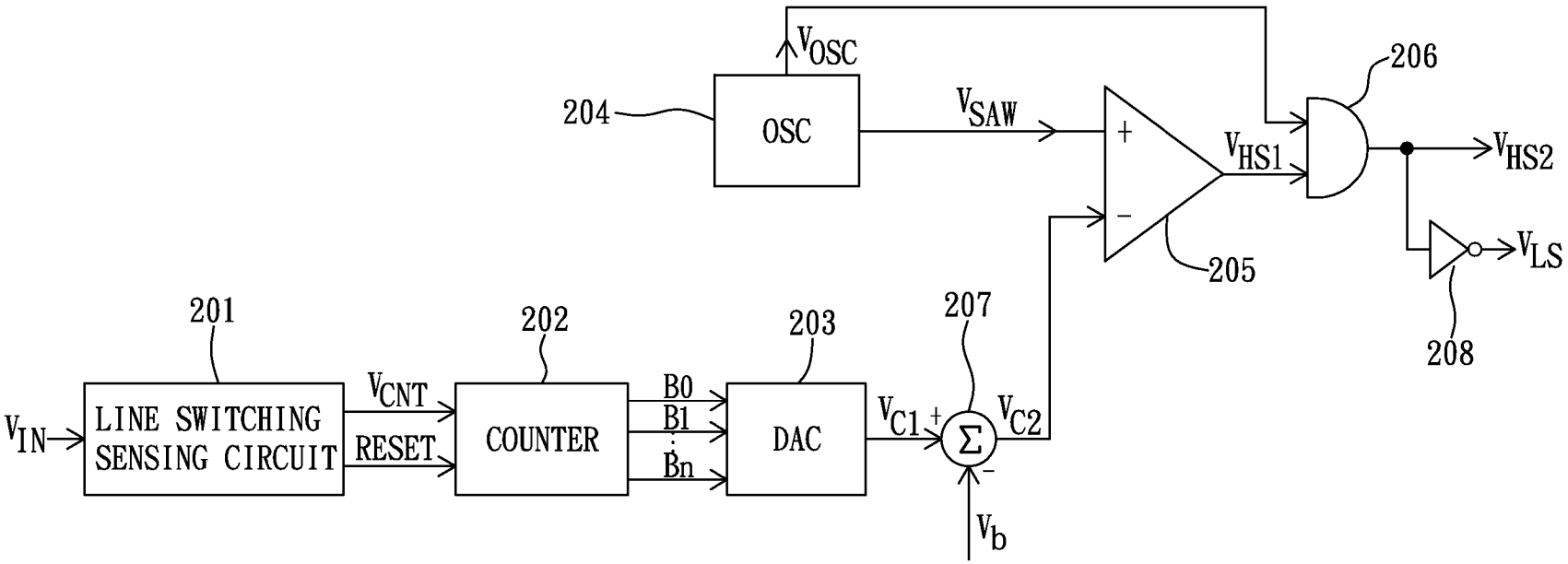
FIG. 2 is a block diagram of an electronic ballast according to a preferred embodiment of the present invention.

Please refer to FIG. 2, which shows a block diagram of a single-chip electronic ballast for driving a fluorescent lamp according to a preferred embodiment of the present invention. As shown in FIG. 2, the electronic ballast comprises a line switching sensing circuit 201, a counter 202, a digital-to-analog converter 203, an oscillator 204, a comparator 205, an AND-gate 206, a combiner 207 and an inverter 208.

The line switching sensing circuit 201 is used to generate a switching sensing signal $V_{CNT}$ by performing a first voltage comparison operation on a DC voltage derived from a main input voltage $V_{IN}$, and generate a reset signal RESET by counting the off time of the power line or by performing a second voltage comparison operation on a filtered DC voltage derived from the main input voltage $V_{IN}$, wherein the first voltage comparison operation can be implemented with a comparator or a Schmitt trigger.

The counter 202 is used to generate a digital count value $B_nB_n \ldots B_1B_0$ according to the switching sensing signal $V_{CNT}$ and the counter 202 is reset by the reset signal RESET.

The digital-to-analog converter 203 is used to generate a first control voltage $V_{C1}$ according to the digital count value $B_nB_n \ldots B_1B_0$. The digital-to-analog converter 203 together with the counter 202 forms a control voltage generator, used to generate the first control voltage $V_{C1}$ according to the digital count value $B_nB_{n-1} \ldots B_1B_0$ of the switching sensing signal $V_{CNT}$, and the control voltage generator is reset by the reset signal RESET when the off time of the power line exceeds a predetermined time.

The oscillator 204 is used to generate a saw-tooth signal $V_{SAW}$ and an oscillating signal $V_{OSC}$, wherein the saw-tooth signal $V_{SAW}$, having a rising voltage portion and a falling voltage portion, is of a fixed frequency, for example but not limited to 45 $Kh_z$, and the oscillating signal $V_{OSC}$, a symmetric square signal, has a frequency equal to half of that of the saw-tooth signal $V_{SAW}$.

The comparator 205, the AND-gate 206, the combiner 207 and the inverter 208 are used to generate a high side gating signal $V_{HS2}$ and a low side gating signal $V_{LS}$ according to the saw-tooth signal $V_{SAW}$, the oscillating signal $V_{OSC}$ and the first control voltage $V_{C1}$, wherein the comparator 205 is used to generate a first high side gating signal $V_{HS1}$ according to voltage comparison of the saw-tooth signal $V_{SAW}$ and a second control signal $V_{C2}$; the AND-gate 206 is used to generate the high side gating signal $V_{HS2}$ according to the logic-AND of the oscillating signal $V_{OSC}$ and the first high side gating signal $V_{HS1}$; the combiner 207 is used to generate the second control signal $V_{C2}$ by subtracting the first control signal $V_{C1}$ with a bias voltage $V_b$; and the inverter 208 is used to generate the low side gating signal $V_{LS}$ according to the high side gating signal $V_{HS2}$. The voltage of the second control signal $V_{C2}$, which can be one of a plurality of discrete values, is used to determine a duty ratio of the first high side gating signal $V_{HS1}$ in a way that, as the voltage of the second control signal $V_{C2}$ is raised to a higher one, the duty ratio of the first high side gating signal $V_{HS1}$ and the duty ratio of the high side gating signal $V_{HS2}$ will be changed to a smaller one (for example, from 50% to 40%) and the luminance of the fluorescent lamp will thereby be dimmed to a lower value. The bias voltage $V_b$ is used to modify the duty ratio values of the high side gating signal $V_{HS2}$ to provide a different set of luminance values. For example, if the digital count value of the counter 202 is represented by two bits, then there will be a level 0, a level 1, a level 2 and a level 3 of the dimming levels of the fluorescent lamp available, and let the relation between the dimming level, the luminance and the second control signal $V_{C2}$ be as follows:

| | Dimming level | | | |
|---|---|---|---|---|
| | Level 0 | Level 1 | Level 2 | Level 3 |
| $V_{C2}$ | 0 V | 1 V | 2 V | 3 V |
| Luminance, | 100% | 75% | 50% | 25% |

then a value of the bias voltage $V_b$ will reduce the voltage of the $V_{C2}$ to provide a different luminance profile.

Figure 5:
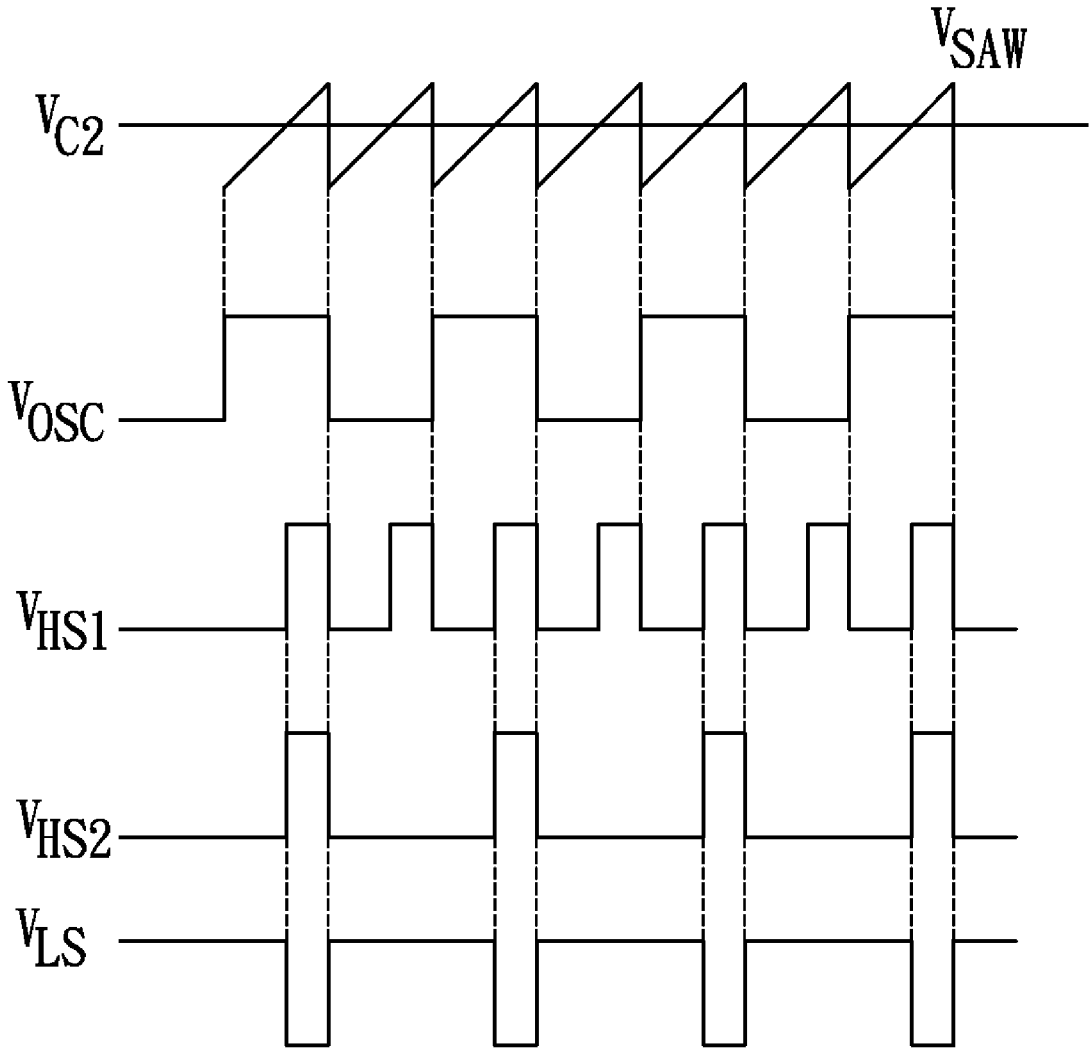
FIG. 5 is a waveform diagram of the related signals of the electronic ballast in FIG. 2 corresponding to a dimming level.

The waveform of the related signals of the electronic ballast in FIG. 2 corresponding to a dimming level is shown in FIG. 5. As shown in FIG. 5, the frequency of $V_{SAW}$ is fixed and the frequency of $V_{OSC}$ is half of that of $V_{SAW}$. The $V_{SAW}$, used to compare with the second control signal $V_{C2}$, has a rising voltage portion and a falling voltage portion, and the $V_{OSC}$ is a symmetric square signal. When $V_{SAW}$ exceeds $V_{C2}$, the first high side gating signal $V_{HS1}$ will exhibit high level and thereby exhibit a duty ratio. The high side gating signal $V_{HS2}$ is the logic-AND result of $V_{OSC}$ and $V_{HS1}$, and the low side gating signal $V_{LS}$ is generated according to the high side gating signal $V_{HS2}$.

Figure 3A:
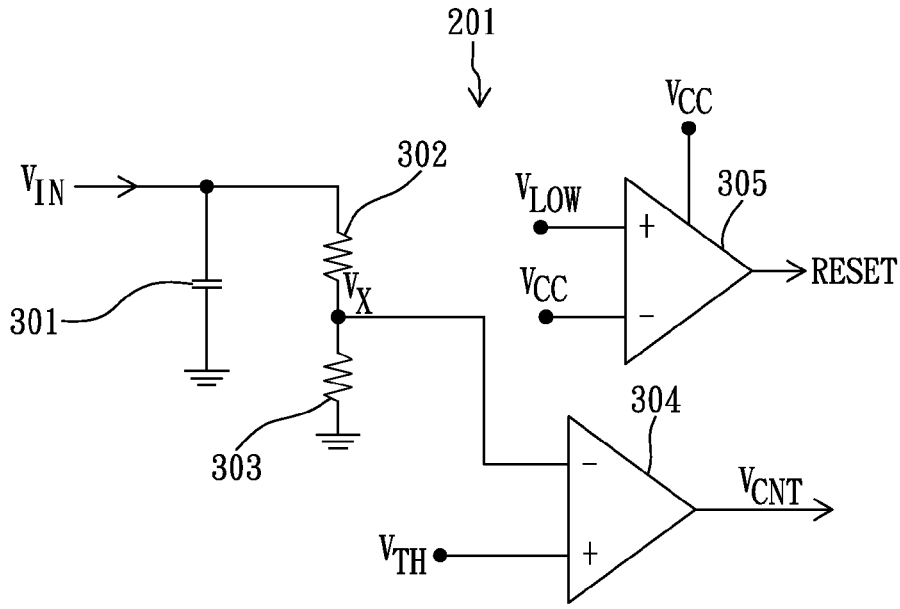
FIG. 3*a* is a block diagram of the line switching sensing circuit in FIG. 2 according to a preferred embodiment of the present invention.

Please refer to FIG. 3*a*, which shows a block diagram of the line switching sensing circuit in FIG. 2 according to a preferred embodiment of the present invention. As shown in FIG. 3*a*, the preferred embodiment of the present invention at least includes a capacitor 301, a resistor 302, a resistor 303, a comparator 304, and a comparator 305.

The capacitor 301 is used to filter out the noise of the main input voltage $V_{IN}$.

The resistor 302 and the resistor 303 are used to act as a voltage divider to generate a DC voltage $V_X$ according to the main input voltage $V_{IN}$.

The comparator 304 is used to generate the switching sensing signal $V_{CNT}$ according to a sensing threshold voltage $V_{TH}$ and the DC voltage $V_X$. The sensing threshold voltage $V_{TH}$, is preferably set, for example but not limited to 11V. FIG. 3*c* shows the resulting waveform of $V_{IN}$, $V_X$, and $V_{CNT}$ when the lamp switch is consecutively switched on and off. As shown in FIG. 3*c*, when $V_X$ falls below the sensing threshold voltage $V_{TH}$, the switching sensing signal $V_{CNT}$ will change state from low to high; when $V_X$ rises above the sensing threshold voltage $V_{TH}$, the switching sensing signal $V_{CNT}$ will change state from high to low.

The comparator 305 is used to generate the reset signal RESET according to a reset threshold voltage $V_{LOW}$ and a filtered DC voltage $V_{CC}$ for the power supply of the comparator 305, wherein the reset threshold voltage $V_{LOW}$, for example but not limited to 6V, is greater than the minimum operation voltage of the ballast controller. When the lamp switch is switched off, the main input voltage $V_{IN}$ will be pulled down immediately, but meanwhile the filtered DC voltage $V_{CC}$ is gradually decreasing due to the charge stored in a bypass capacitor for the filtered DC voltage $V_{CC}$. Therefore as the lamp switch is switched off, the filtered DC voltage $V_{CC}$ will not fall below the reset threshold voltage $V_{LOW}$ until the switch-off time exceeds a predetermined time, for example 1 sec, depending on the capacitance of the bypass capacitor.

Figure 3B:
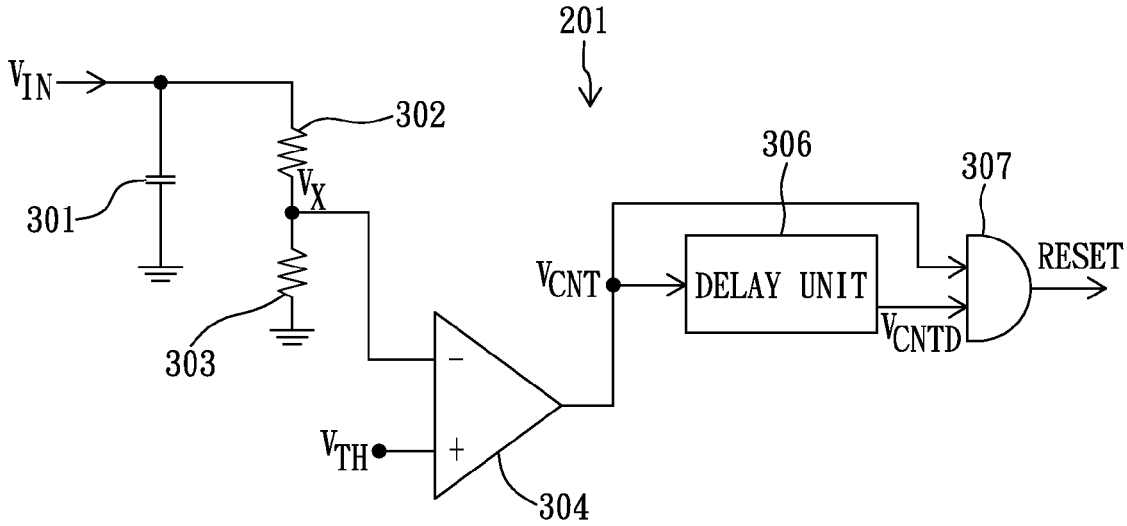
FIG. 3*b* is a block diagram of the line switching sensing circuit in FIG. 2 according to another preferred embodiment of the present invention.
Figure 3C:
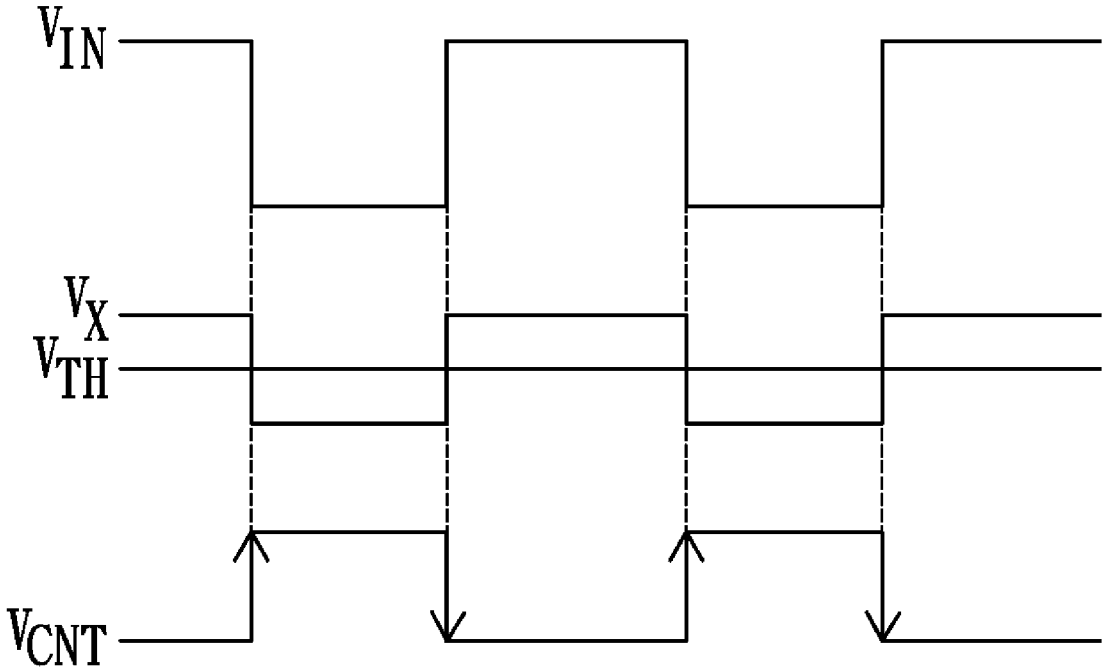
FIG. 3*c* is a waveform diagram of $V_X$ and $V_{cnt}$ in FIG. 3*a* and FIG. 3*b* when the AC power is switched on and off consecutively.

Please refer to FIG. 3*b*, which shows a block diagram of the line switching sensing circuit in FIG. 2 according to another preferred embodiment of the present invention. As shown in FIG. 3*b*, the preferred embodiment of the present invention at least includes a capacitor 301, a resistor 302, a resistor 303, a comparator 304, a delay unit 305 and an AND gate 306.

The capacitor 301 is used to filter out the noise of the main input voltage $V_{IN}$.

The resistor 302 and the resistor 303 are used to act as a voltage divider to generate a DC voltage $V_X$ according to the main input voltage $V_{IN}$.

The comparator 304 is used to generate the switching sensing signal $V_{CNT}$ according to a sensing threshold voltage $V_{TH}$ and the DC voltage $V_X$. The sensing threshold voltage $V_{TH}$, is preferably set, for example but not limited to 11V. FIG. 3*c* shows the resulting waveform of $V_{IN}$, $V_X$, and $V_{CNT}$ when the lamp switch is consecutively switched on and off. As shown in FIG. 3*c*, when $V_X$ falls below the sensing threshold voltage $V_{TH}$, the switching sensing signal $V_{CNT}$ will change state from low to high; when $V_X$ rises above the sensing threshold voltage $V_{TH}$, the switching sensing signal $V_{CNT}$ will change state from high to low.

The delay unit 305 is used to delay the switching sensing signal $V_{CNT}$ with the predetermined time to generate a delayed signal $V_{CNTD}$.

The AND gate 306 is used to generate the reset signal RESET according to the switching sensing signal $V_{CNT}$ and the delayed signal $V_{CNTD}$. When the pulse width of the switching sensing signal $V_{CNT}$ is shorter than the predetermined time, the reset signal RESET will stay low; when the pulse width of the switching sensing signal $V_{CNT}$ is longer than the predetermined time, the reset signal RESET will change state to high.

Figure 4A:
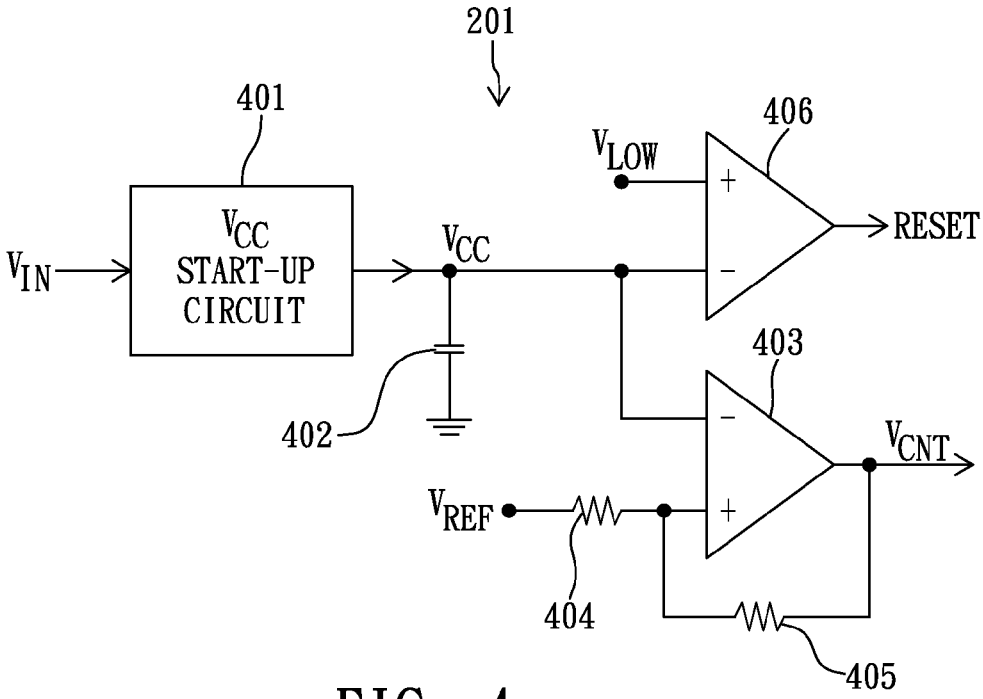
FIG. 4*a* is a block diagram of the line switching sensing circuit in FIG. 2 according to still another preferred embodiment of the present invention.

FIG. 4*a* shows a block diagram of the line switching sensing circuit in FIG. 2 according to still another preferred embodiment of the present invention. As shown in FIG. 4*a*, the preferred embodiment of the present invention at least includes a $V_{CC}$ start-up circuit 401, a bypass capacitor 402, a comparator 403, a resistor 404, a resistor 405 and a comparator 406.

The $V_{CC}$ start-up circuit 401 is used in generating the filtered DC voltage $V_{CC}$ according to the main input voltage $V_{IN}$.

The bypass capacitor 402 is used to filter out the noise of the filtered DC voltage $V_{CC}$.

The comparator 403, the resistor 404, and the resistor 405 are used to implement a Schmitt trigger to generate the switching sensing signal $V_{CNT}$ according to the voltage $V_{CC}$. The low threshold voltage of the Schmitt trigger is set according to a UVLO (Under Voltage Lock Out) turn-off level, for example but not limited to 9V, and the high threshold voltage of the Schmitt trigger is set according to a UVLO turn-on level, for example but not limited to 13V. FIG. 4*c* shows the resulting waveform of $V_{IN}$, $V_{CC}$ and $V_{CNT}$ when the lamp switch is consecutively switched on and off. When $V_{CC}$ falls below the UVLO turn-off level, the switching sensing signal $V_{cnt}$ will change state from low to high; when $V_{CC}$ rises beyond the UVLO turn-on level, the switching sensing signal $V_{CNT}$ will change state from high to low.

The comparator 406 is used to generate the reset signal RESET according to a reset threshold voltage $V_{LOW}$ and the filtered DC voltage $V_{CC}$, wherein the reset threshold voltage $V_{LOW}$, for example but not limited to 6V, is greater than the minimum operation voltage of the ballast controller. When the lamp switch is switched off, the main input voltage $V_{IN}$ will be pulled down immediately, but meanwhile the filtered DC voltage $V_{CC}$ is gradually decreasing due to the charge stored in the bypass capacitor 402 for the filtered DC voltage $V_{CC}$. Therefore as the lamp switch is switched off, the filtered DC voltage $V_{CC}$ will not fall below the reset threshold voltage $V_{LOW}$ until the switch-off time exceeds a predetermined time, for example 1 sec, depending on the capacitance of the bypass capacitor 402.

Figure 4B:
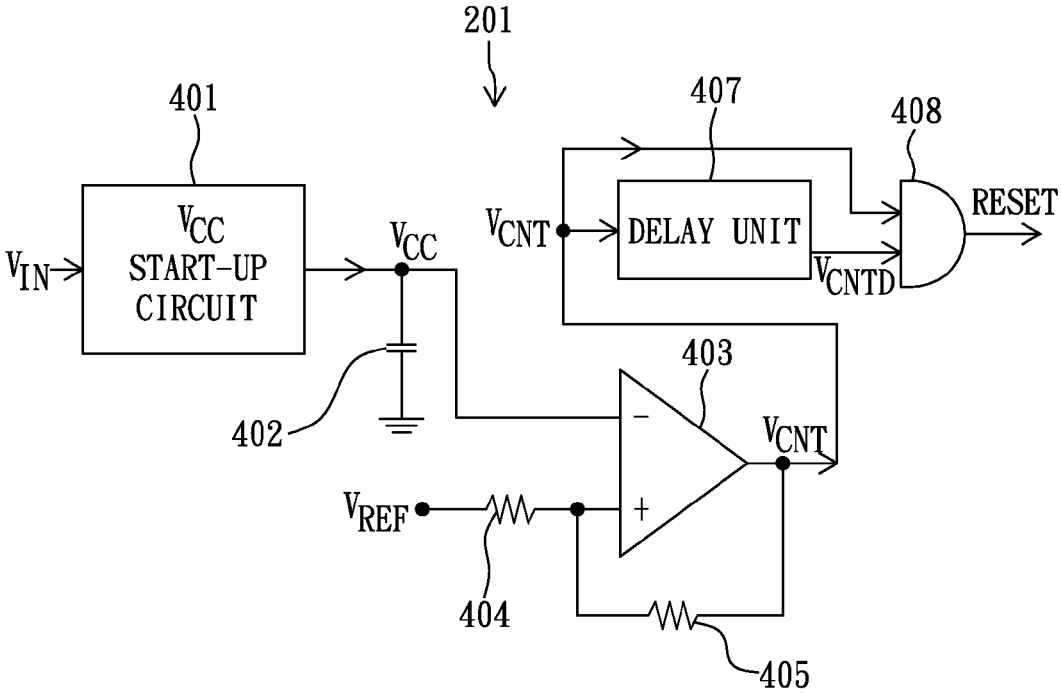
FIG. 4*b* is a block diagram of the line switching sensing circuit in FIG. 2 according to still another preferred embodiment of the present invention.
Figure 4C:
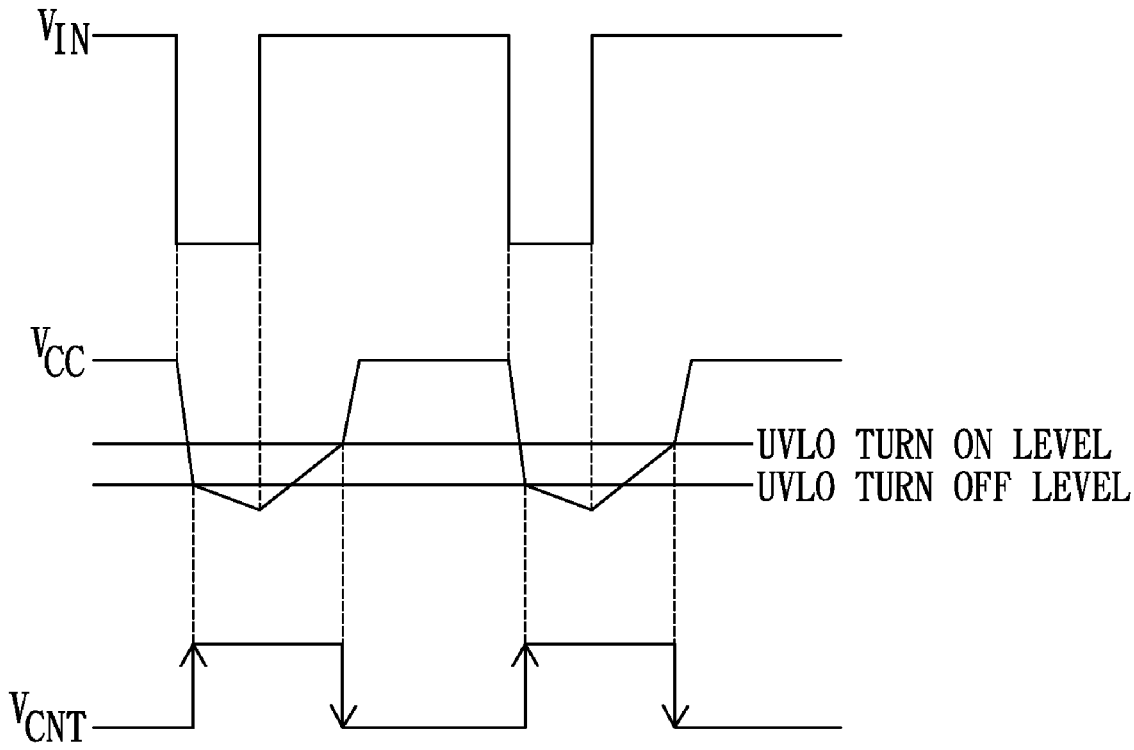
FIG. 4*c* is a waveform diagram of $V_{CC}$ and $V_{cnt}$ in FIG. 4*a* and FIG. 4*b* when the AC power is switched on and off consecutively.

FIG. 4*b* shows a block diagram of the line switching sensing circuit in FIG. 2 according to still another preferred embodiment of the present invention. As shown in FIG. 4*b*, the preferred embodiment of the present invention at least includes a $V_{CC}$ start-up circuit 401, a bypass capacitor 402, a comparator 403, a resistor 404, a resistor 405 a delay unit 406 and an AND gate 407.

The $V_{CC}$ start-up circuit 401 is used in generating the filtered DC voltage $V_{CC}$ according to the main input voltage $V_{IN}$.

The bypass capacitor 402 is used to filter out the noise of the filtered DC voltage $V_{CC}$.

The comparator 403, the resistor 404, and the resistor 405 are used to implement a Schmitt trigger to generate the switching sensing signal $V_{CNT}$ according to the voltage $V_{CC}$. The low threshold voltage of the Schmitt trigger is set according to a UVLO (Under Voltage Lock Out) turn-off level, for example but not limited to 9V, and the high threshold voltage of the Schmitt trigger is set according to a UVLO turn-on level, for example but not limited to 13V. FIG. 4*c* shows the resulting waveform of $V_{IN}$, $V_{CC}$ and $V_{CNT}$ when the lamp switch is consecutively switched on and off. When $V_{CC}$ falls below the UVLO turn-off level, the switching sensing signal $V_{cnt}$ will change state from low to high; when $V_{CC}$ rises beyond the UVLO turn-on level, the switching sensing signal $V_{CNT}$ will change state from high to low.

The delay unit 406 is used to delay the switching sensing signal $V_{CNT}$ with the predetermined time to generate a delayed signal $V_{CNTD}$. The AND gate 407 is used to generate the reset signal RESET according to the switching sensing signal $V_{CNT}$ and the delayed signal $V_{CNTD}$. When the pulse width of the switching sensing signal $V_{CNT}$ is shorter than the predetermined time, the reset signal RESET will stay low; when the pulse width of the switching sensing signal $V_{CNT}$ is longer than the predetermined time, the reset signal RESET will change state to high.

Through the implementation of the present invention, a fully integrated single-chip electronic ballast capable of dimming control of a fluorescent lamp by sensing the count of switching of a lamp switch is presented. The topology of the present invention is much more concise than prior art circuits, so the present invention does conquer the disadvantages of prior art circuits.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. An electronic ballast with dimming control from power line sensing for a fluorescent lamp, comprising:

a control voltage generator, used to generate a control voltage according to a switching count of a power line;

an oscillator, used to generate a first oscillating signal, wherein said first oscillating signal is of a fixed frequency and has a rising voltage portion and a falling voltage portion; and a comparator, used to generate a high side gating signal according to voltage comparison of said first oscillating signal and said control voltage.

2. The electronic ballast with dimming control from power line sensing as claim 1, wherein said control voltage generator comprises:

a line switching sensing circuit, used to generate a line switching sensing signal by sensing the voltage of said power line;

a counter, used to generate a digital count value according to said switching sensing signal; and a digital-to-analog converter, used to generate said control voltage according to said digital count value.

3. The electronic ballast with dimming control from power line sensing as claim 2, wherein said line switching sensing circuit comprises:

a capacitor, used to filter out a noise of said power line;

a voltage divider, used to generate a DC voltage according to said power line;

a comparator, used to generate said switching sensing signal according to said DC voltage and a sensing threshold voltage.

4. The electronic ballast with dimming control from power line sensing as claim 2, wherein said line switching sensing circuit comprises:

a start-up circuit, used in generating a filtered DC voltage according to said power line;

a capacitor, used to filter out a noise of said filtered DC voltage;

a Schmitt trigger, used to generate said switching sensing signal according to said filtered DC voltage, wherein said Schmitt trigger has a high threshold voltage corresponding to a UVLO turn-on level, and a low threshold voltage corresponding to a UVLO turn-off level.

5. The electronic ballast with dimming control from power line sensing as claim 1, wherein said control voltage generator comprises:

a line switching sensing circuit, used to generate a line switching sensing signal by sensing the voltage of said power line;

a counter, used to generate a digital count value according to said switching sensing signal;

a digital-to-analog converter, used to generate a first control voltage according to said digital count value; and a combiner, used to combine said first control voltage with a bias voltage to generate said control voltage.

6. An electronic ballast with dimming control from power line sensing for a fluorescent lamp, wherein said electronic ballast is integrated in a single chip, said electronic ballast comprising:

a control voltage generator, used to generate a control voltage according to a switching count of a power line;

an oscillator, used to generate a first oscillating signal and a second oscillating signal, wherein said first oscillating signal is of a fixed frequency and has a rising voltage portion and a falling voltage portion, and said second oscillating signal is a square signal of which the frequency is half of that of said first oscillating signal;

a comparator, used to generate a first high side gating signal according to voltage comparison of said first oscillating signal and said control voltage; and an AND gate, used to generate a high side gating signal according to said first high side gating signal and said second oscillating signal.

7. The electronic ballast with dimming control from power line sensing as claim 6, wherein said control voltage generator comprises:

a line switching sensing circuit, used to generate a line switching sensing signal by sensing the voltage of said power line;

a counter, used to generate a digital count value according to said switching sensing signal; and a digital-to-analog converter, used to generate said control voltage according to said digital count value.

8. The electronic ballast with dimming control from power line sensing as claim 6, further comprising an inverter, which is used to invert said high side gating signal to generate a low side gating signal.

9. The electronic ballast with dimming control from power line sensing as claim 6, wherein said control voltage generator comprises:

a line switching sensing circuit, used to generate a line switching sensing signal by sensing the voltage of said power line;

a counter, used to generate a digital count value according to said switching sensing signal;

a digital-to-analog converter, used to generate a first control voltage according to said digital count value; and a combiner, used to combine said first control voltage with a bias voltage to generate said control voltage.

10. The electronic ballast with dimming control from power line sensing as claim 6, wherein said first oscillating signal is a saw-tooth signal.

* * * * *